US005466149A

United States Patent [19]

Tsai

[11] Patent Number: 5,466,149

[45] Date of Patent: Nov. 14, 1995

[54] HEATING TORCH

[76] Inventor: Chin-Lin Tsai, 3F, No. 94, Sec. 4, Chung Hsin Rd., San Chung City, Taipei Hsien, Taiwan

[21] Appl. No.: 382,628

[22] Filed: Feb. 2, 1995

[51] Int. Cl.[6] ..... F23D 14/28

[52] U.S. Cl. ..... 431/344; 431/255; 126/407; 126/413

[58] Field of Search ..... 431/255, 344, 431/354, 264, 265; 126/401, 407, 413, 406, 414, 405

[56] References Cited

U.S. PATENT DOCUMENTS 3,597,732 7/1986 Yoshinaga ..... 431/344
4,804,324 2/1989 Yoshinaga ..... 431/34
4,952,138 8/1990 Ho ..... 431/344

*Primary Examiner*—James C. Yeung
*Attorney, Agent, or Firm*—Buckman and Archer

[57] ABSTRACT

An improved heating torch including a barrel, a top mounting, a gas release device, a flame device and a casing unit. After assembly, by turning a switch button, the flow of fuel gas and initiation of a piezoelectric device to start ignition may be controlled. Two copper sheets which retain a regulating sponge therebetween regulate the pressure of fuel gas for maintaining a stable pressure. The reciprocating movement of a control core conceals or opens a connecting hole for regulating gas flow. A ring notch and a corresponding air vent controls the mixture of air and fuel gas. A front end of the heating torch may further be provided with a soldering-iron, and a base plate is provided on the bottom of the barrel for keeping the torch in a stable position.

6 Claims, 4 Drawing Sheets

HEATING TORCH

BACKGROUND OF THE INVENTION

The present invention relates generally to a heating torch, and more particularly to an improved heating torch which may be held in one hand.

Compressed liquefied gas is not only used in households, it is also used in cigarette lighters because it is clean and may be refilled easily. It is also used in blow torches and soldering-irons.

In using gas blow torches (i.e., so-called heating torches) or soldering-irons, the object is to control the intensity of fire and to achieve easy assembly. Certainly, safety and facility of operation are also basic considerations. Known gas blow torches and soldering-irons are not equipped with ignition devices. Therefore, when in use, it is necessary to light the flame outlet of such devices. In addition, these devices are not equipped with pressure regulating means and flame regulators so that in actual use, the fuel pressure and gas feed amount can not be regulated, therefore the expected effects are not obtainable.

SUMMARY OF THE INVENTION

The primary object of the present invention is to provide a heating device that can be held in one hand and operated and which has the functions of both blow torches and soldering-irons.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
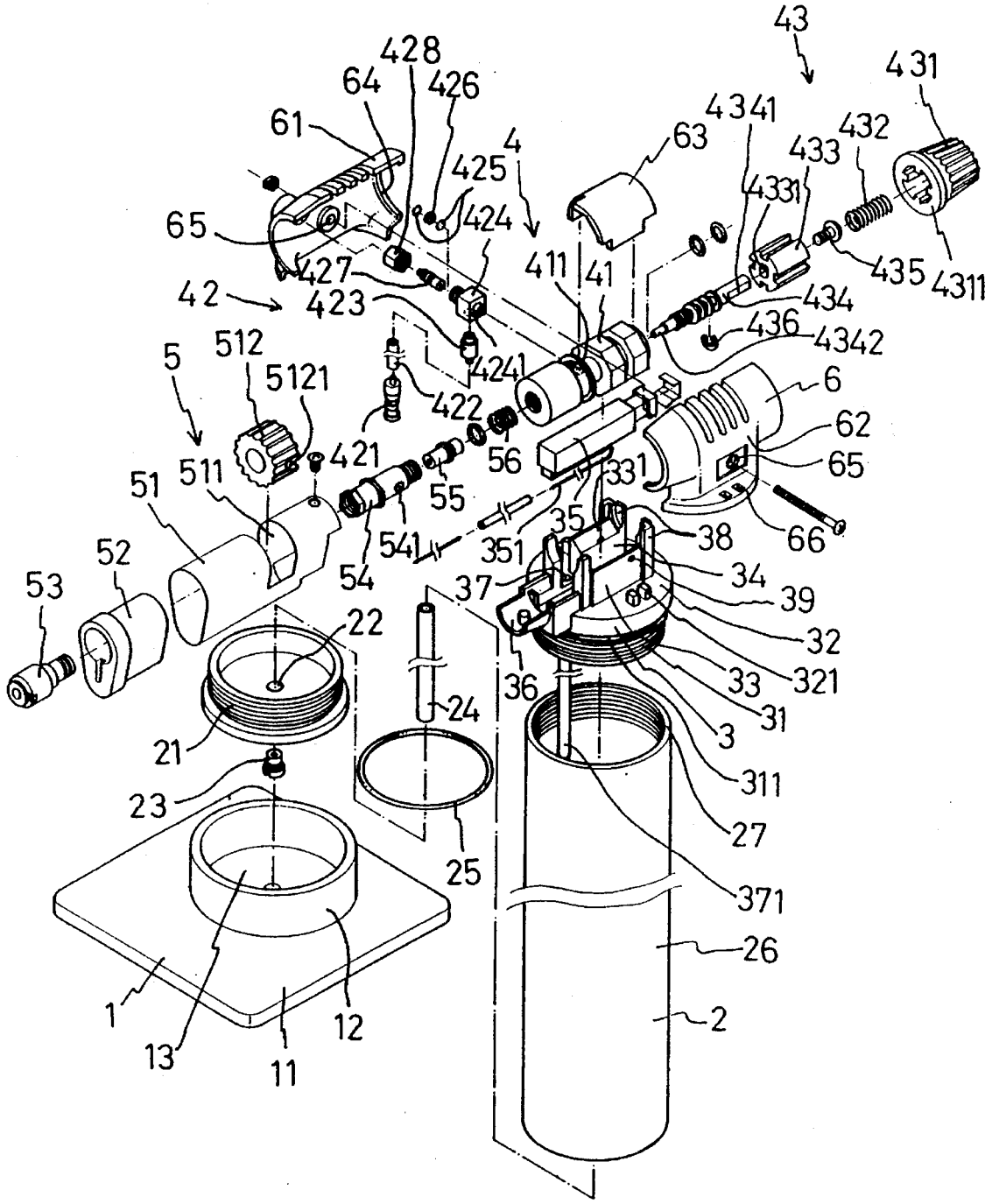
FIG. 1 is a perspective exploded view of the heating torch of the present invention.

With reference to the drawings, the heating torch of the present invention mainly comprises a base 1, a barrel 2, a top mounting 3, a gas release device 4, a flame device 5 and a casing unit 6. The base 1 consists of a base plate 11 and a ring 12 extending perpendicularly from the center thereof. A round opening or hole 13 is disposed in the ring 12, corresponding to the barrel 2 to permit level and stable placement thereof.

The barrel 2 is a conventional hollow tubular structure the outer diameter thereof corresponding to the round hole 13 for insertion. The barrel 2 has a bottom 21 the center thereof having a hole 22 to which is screwably connected an intake nozzle 23 for the filling of fuel. A fuel intake tube 24 is insertably fitted into the intake nozzle 23 of the hole 22 in the bottom 21. A ring 25 is fitted onto the bottom 21 which is screwably connected to the barrel body 26 and the upper inner wall of barrel body 26 is provided with threads 27 for connection with the top mounting 3.

The top mounting 3 has a threaded ring 31 corresponding to the threads 27 of barrel body 26. The upper portion of the threaded ring 31 extends integrally to a rim 32 with both sides thereof being respectively provided with a pair of tenons 321 for engaging with the casing unit 6. The central portion of the rim 32 extends perpendicularly to form two parallel walls 33 the upper parts of which are configured to be inclined walls 331 for receiving a gas core set 41 and the space therebetween defining a chamber 34 for accommodating a piezoelectric device 35 (of the conventional type), which has a conventional conductive wire 351 extending to the flame device 5. In addition, the front part of the top wall 33 extends integrally to an arched lug 36 for a flame device 5 to straddle thereon. A gas outlet 37 is disposed to the side of chamber 34 and is linked to a gas outlet tube 371 disposed in the body 26 of the barrel 2. Besides, the rear ends of the two walls 33 respectively extend to form tenons 38 for restricting the backward movement of a switch core shaft 434.

The gas release device 4 mainly comprises a gas core seat 41 which straddles across the recess 34, a laterally oriented pressure regulating valve seat 42 and a switch seat 43 to the rear of the pressure regulating valve seat 42. The gas core seat 41 is a polygonal hollow tube structure having a socket 411 provided in a lateral side thereof, the socket 411 being connected to the pressure regulating valve seat 42. The pressure regulating valve seat 42 consists of a connecting shaft 421 linking the gas outlet 37 and connected to a soft tube 422 further connected to a relay connector 423. A connecting hole 4241 of a pressure regulating seat 424 is insertably fitted with the relay connector 423. The interior of the pressure regulating seat 424 contains two copper sheets 425 and a regulating sponge 426 held therebetween for maintaining a stable fuel gas pressure. The other end of the pressure regulating seat 424 is further screwably connected to a control core 427 and a control cap 428 which is exposed on the casing 6. Hence, when turning the control core 427, the control core 427 is caused to reciprocate to conceal the size of the connecting hole 4241 so as to control the flow of fuel gas. The function of the control cap 428 is to prevent the control core 427 from slipping off. In addition, the other end of the pressure regulating seat 424, as mentioned above, is connected to the socket 411, defining a fuel gas path.

The switch seat 43 consists of a switch button 431 on one side thereof having a button rim 4311 for pressing a piezoelectric device 35 when the switch button 431 is pressed so that the piezoelectric core 351 generates electrostatic sparks. The switch button 431 further contains a switch spring 432 and a switch rotor 433 which has a rectangular hole 4331 in the center thereof. After a shaft end 4341 of the switch core shaft 434 is fitted into the rectangular hole 4331, the switch rotor 433 and the switch core shaft 434 are locked together by means of a screw 435, so that the switch rotor 433 and the switch core shaft 434 may perform linked movement. The front end of the switch core shaft 434 is a tapered switch end 4342. After assembly of the heating torch of the present invention, the switch end 4342 extends past the socket 411 to buttress against a rear end of the flame device 5. In addition, an E-ring 436 is insertably fitted onto the switch core shaft 434 for restricting the movement of the switch core shaft 434. Therefore, when the switch button 431 is turned, causing switch rotor 433 to turn which in turn causes the shaft end 4341 to move therewith, the switch core shaft 434 is simultaneously turned. The switch end 4342, because of the threaded engagement of switch core shaft 434 with gas core seat 41, is caused to seal the socket 411 when it is turned. In order to seal the socket 411 or adjust the flow of fuel gas, the E-ring 436 is pressed against the tenons 38 to restrict the turning of the switch core shaft 434, so as to prevent the switch core shaft 434 from over-displacement which may result in fuel gas leakage.

In addition, the switch button 431 may slidably move on the switch rotor 433 so that the switch button 431 may, after pressing the piezoelectric device 35, retract to its original position by means of the spring 432.

The flame device 5 consists of a jacket 51, a refractory ring 52 fitted therein, a flame nozzle 53 of the conventional type disposed in the refractory ring 52, a gas outlet tube shaft 54, a gas nozzle 55 and a spring 56. The flame nozzle 53 is passed through the refractory ring 52 to be secured to the gas outlet tube shaft 54. After the gas nozzle 55 is inserted into the gas outlet tube shaft 54, one end thereof is fitted with the spring 56 and is secured within the gas core seat 41. The piezoelectric core 351 of the piezoelectric device 35 passes through the recess 34, the lug 36, the jacket 51 and the refractory ring 52 to be located at one end of the flame nozzle 53. A portion of the jacket 51 is configured to be a recess 511 for receiving a regulating ring 512. One end of the regulating ring 512 has a notch 5121, which corresponds to a vent hole 541 disposed in one side of the gas outlet tube shaft 54, and by means of the connection of the notch 5121 and the vent hole 541, the intake of ambient air may be controlled.

The casing 6 consists of a left casing 61, a right casing 62 and a securing lid 63. The arrangement of the casing 6 is to envelop the gas release device 4. A couple of holes 66 are provided at positions corresponding to the tenons 321, and a projecting rib 64 is respectively provided at each of the end rims of the left and right casings 61, 62, for restricting the movement of the switch button 431 and for preventing the switch button 431 from falling off. A screw is passed through a lock hole 65 and holes 39 in the walls 33 to fasten the left and right casings 61, 62 together.

Figure 2:
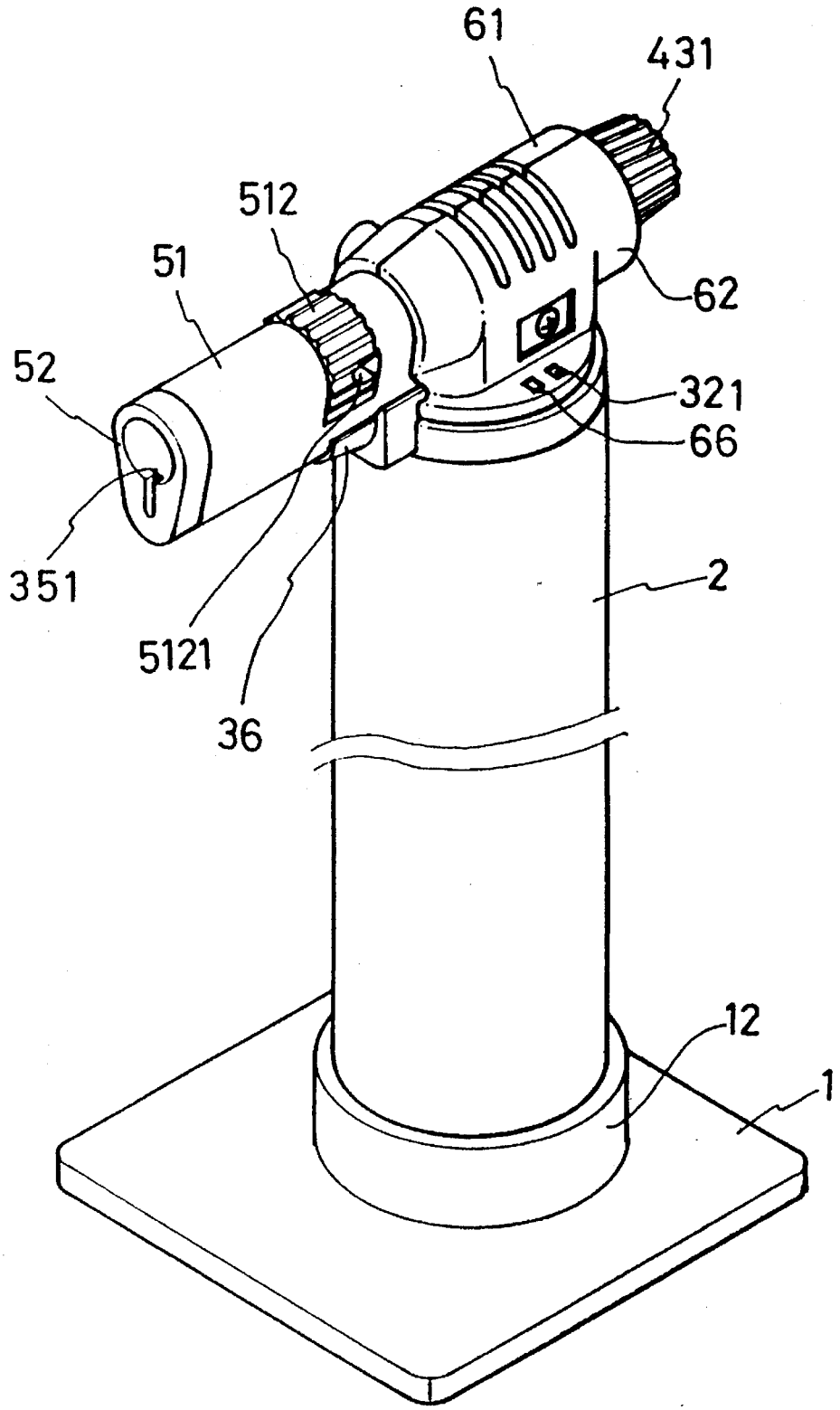
FIG. 2 is a perspective schematic view of the heating torch of the present invention.
Figure 3:
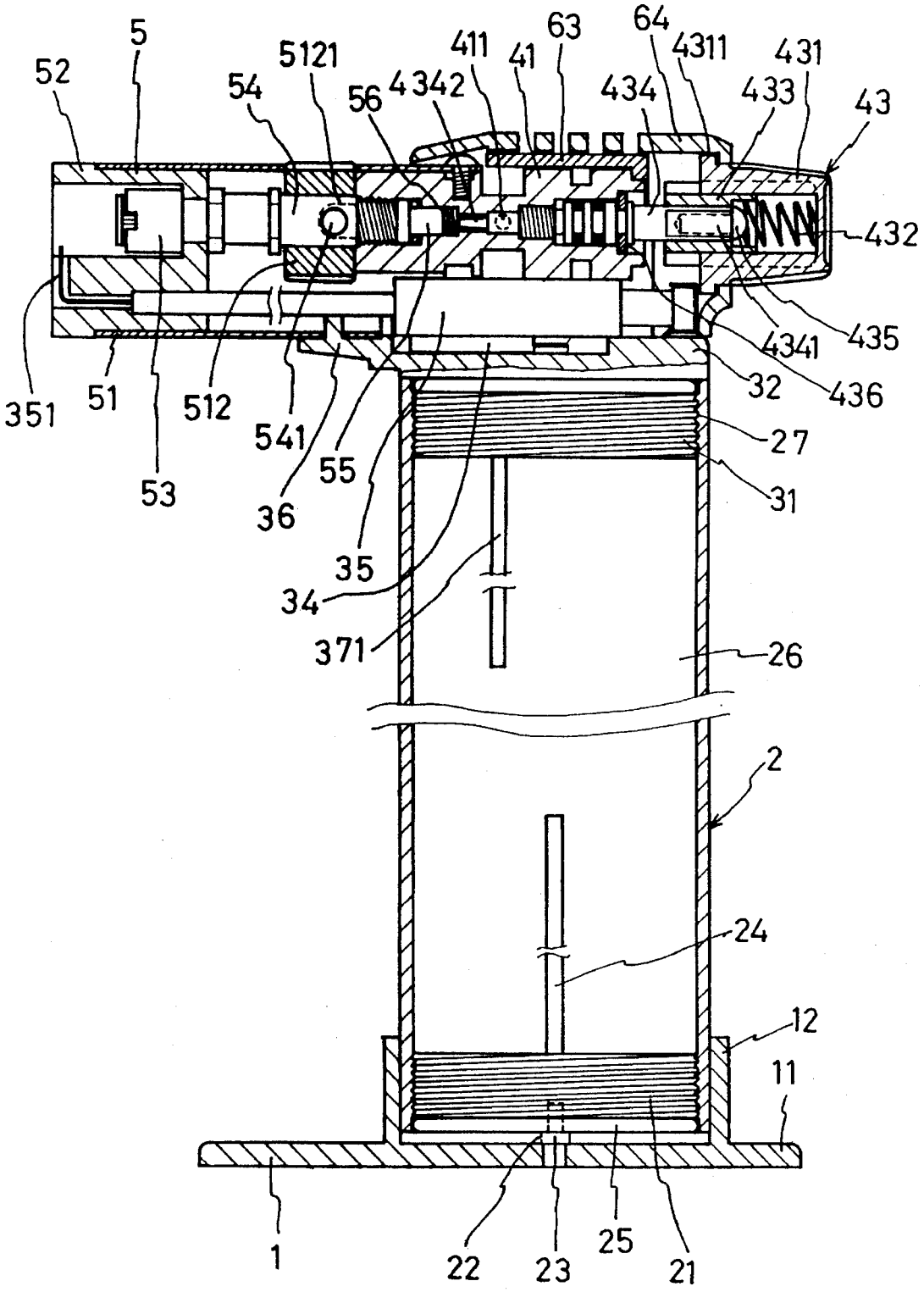
FIG. 3 is a cross-sectional view of the heating torch of the present invention after it is assembled.

With reference to FIG. 2 and 3, during assembly, the intake nozzle 23 is first secured in the bottom hole 22 of the barrel bottom 21. After inserting the fuel intake tube 24 in the intake nozzle 23, the ring 25 of the barrel is placed under the bottom 21 and secured to the lower end of the body 26. After the gas outlet hole 37 in the top mounting 3 are insertably fitted together, the upper portion of the body 26 is fastened with the ring 31 (having a O-ring 311) of the top mounting 3 by means of the threads 27 at the upper rim of the body 26. The piezoelectric device 35 is then placed in the recess 34, and the piezoelectric core 351 is then extended out of the lug 36.

Then, the connecting shaft 421 and the soft tube 422 are joined together, and the soft tube 422 is insertably fitted with the relay connector 423. The relay connector 423 is insertably connected to the connecting hole 4241, while one side of the pressure regulating seat 424 is screwably connected to the control core 427 and the control cap 428. The other side of the pressure regulating seat 424 is insertably fitted with a socket 411, and the switch core shaft 434, after being fitted with the E-ring 436, is locked within the gas core seat 41, so that the switch end 4342 at its front end extends beyond the socket 411. The rear end of the shaft end 4341, after securing with the switch rotor 433, is locked with the switch rotor 433 by means of the screw 435. The switch rotor 433 and the switch spring 432 are both accommodated within the switch button 431.

Subsequently, the gas outlet tube shaft 54 passes the jacket 51 and regulating ring 512. After it is insertably connected to the gas nozzle 55 and spring 56, it is locked with the gas core seat 41. The flame nozzle 53 is locked with the gas outlet tube shaft 54. In addition, the piezoelectric core 351 passes the jacket 51 and refractory ring 52 to be fixedly provided at one side of the flame nozzle 53. By means of a screw passing through the jacket 51, the flame device 5 is screwably fastened onto the gas release device 4, so that the flame device 5 and gas release device 4 unite as a single unit. The unit is then mounted on the inclined wall 331. Then the connecting shaft 421 and the gas outlet 37 are connected together. A gas flow path provided with pressure regulation is thus formed. Subsequently, the securing lid 63 is placed on the gas core seat 41. After the holes 66 of the left and right casings 61, 62, respectively, are joined with the tenons 321, a screw is passed through the lock hole 65 and the holes in the walls 33 to lock them together. The improved heating torch according to the present invention is thus assembled. By turning the switch button 431, the switch core shaft 434 is caused to displace so as to close or open the socket 411 for controlling the flow of fuel gas. The movement of the switch 431 is restricted by the ribs 64 of the casing unit 6 and the button rim 4311 when they are pressed against each other. Moreover, the switch button 431 may slidably move on the switch rotor 433, and hence, the button rim 4311 may be used to press against the piezoelectric device 35. The control cap 428 projects from one side of the left casing 61 and, by means of turning, controls the reciprocating movement of the control core 427, so as to conceal the size of the connecting hole 4241, further controlling the flow of fuel gas. At the same time, by turning the regulating ring 512, the intake of air to be mixed with the fuel gas may be adjusted.

Figure 4:
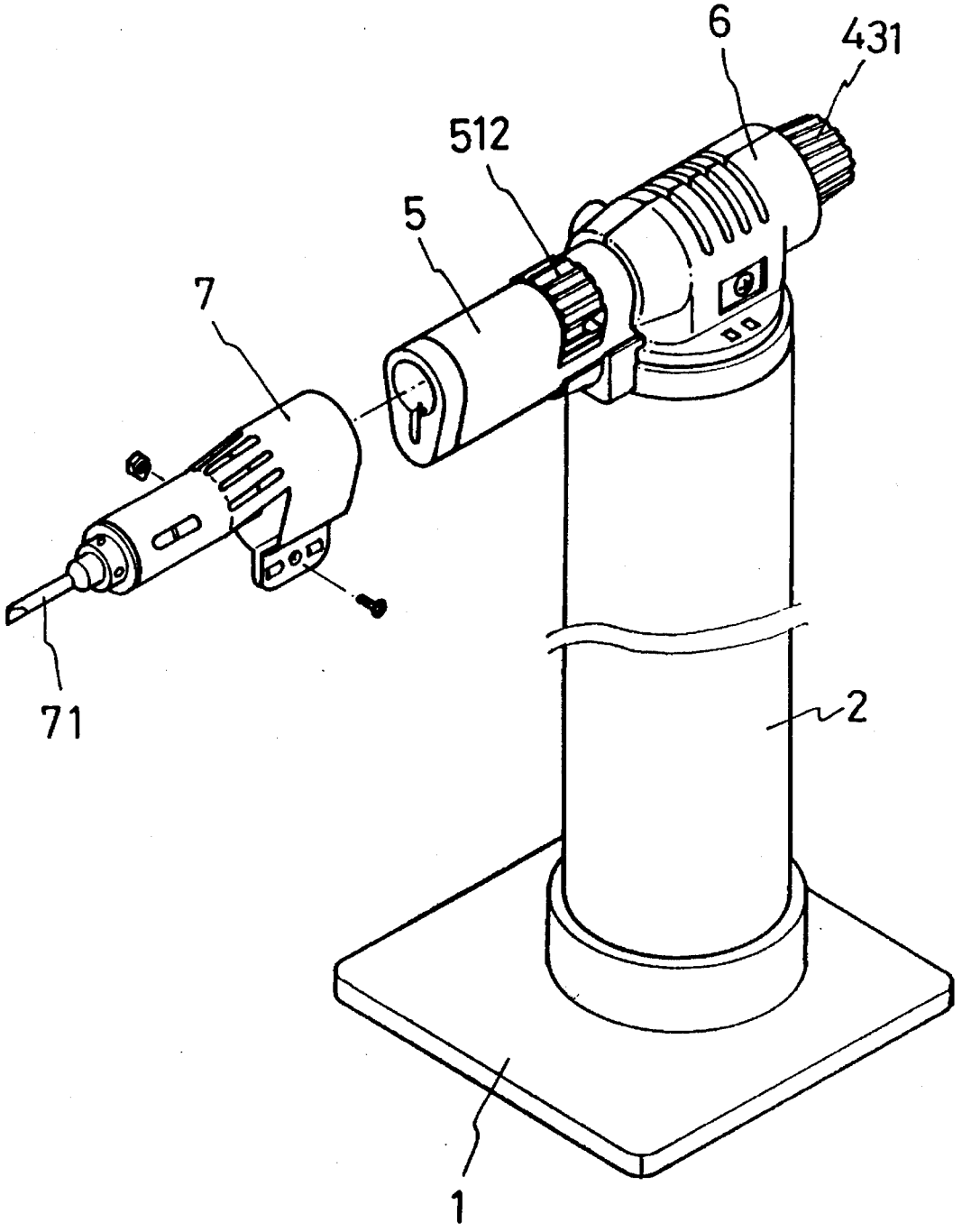
FIG. 4 is a perspective schematic view of the present invention used in soldering.

When the heating torch according to the present invention is used in a soldering-iron, such as that shown in FIG. 4, the soldering-iron is fitted to the front end of the flame device 5. By continuous heating, the solder head 71 becomes heated for melting metals like zinc.

The effects achieved by the improved heating torch of the present invention are summarized as follows:

(1) The control core and switch button may severally control the flow of fuel gas, and the switch button may press against the piezoelectric device to facilitate igniting the flame device. The regulating ring provides multiple regulation of the ratio of air and fuel gas, so that the fire has various intensity for the user's choice. More importantly, the heating torch according to the present invention may be held in one hand, giving greater facility.

(2) The arrangement of the regulating means may help maintain the stability of the air pressure during the process of vaporization of liquefied gas, so that the burning process will not stop due to an abrupt drop of air pressure.

(3) The present invention may be used in soldering, eliminating the drawback of providing a separate soldering-iron as in the conventional art.

(4) The flame device and the gas release device may be separately assembled into complete units, which are then connected with other elements. In production, the drawback of having to assemble all elements simultaneously is eliminated.

Although the present invention has been illustrated and described with reference to the preferred embodiment thereof, it should be understood that it is in no way limited to the details of such embodiment but is capable of numerous modifications within the scope of the appended claims.

What is claimed is:

1. An improved heating torch including a barrel for containing fuel gas, a top mounting on said barrel, a gas release device mounted on said top mounting, a flame device mounted on said top mounting, and a casing unit mounted on said top mounting and covering said gas release device, said gas release device comprising a gas core seat, a laterally oriented pressure regulating valve seat and a switch seat, said gas core seat being a hollow tubular structure connecting said flame device to said switch seat, a socket arranged on a side of said gas core seat to which said pressure regulating valve seat is connected, said pressure regulating valve seat being connected to a gas outlet in the top mounting via a soft tube and a connecting shaft, said pressure regulating valve seat being further connected to a relay connector insertably disposed in a connecting hole of a pressure regulating seat, said pressure regulating seat accommodating two copper sheets and a pressure regulating sponge held therebetween for controlling the pressure of fuel gas, said pressure regulating seat being laterally and threadably connected to a control core and a control cap which is exposed on said casing unit, so that turning said control core moves it forward or backward for controlling the opening or closing of said connecting hole, thereby regulating the fuel gas flow, the other side of said pressure regulating seat being connected to said socket on the side of said gas core seat; and said switch seat comprising a switch core shaft having an E-ring thereon, an end of said switch core shaft passing into a hole of a switch rotor and secured therein with a securing screw, said switch core shaft and said gas core seat being threadably engaged so that a switch end of said switch core shaft extends beyond said socket in said gas core seat, a switch button lockingly engaged for turning with said switch rotor so that turning said switch button controls the opening or closing of said socket for controlling the flow of gas, and said switch button is adapted for slidable movement on said switch rotor for igniting said flame device by a button rim thereof pressing against a piezoelectric ignition device disposed adjacent said switch seat.

2. The improved heating torch as claimed in claim 1, wherein a lower rim of said top mounting has a ring for threadable connection with said barrel, an upper side of said top mounting forms a rim provided with a pair of tenons on opposing sides thereof for engagement with said casing unit, two parallel walls perpendicularly extend from the center of said rim defining a chamber therebetween, said piezoelectric ignition device being arranged in said chamber and being in contact with said button rim of said switch button, a piezoelectric core of said piezoelectric ignition device extending to said flame device, the front end of said walls integrally extending to form an arched lug for mounting thereon said flame device, and one of said mounting walls including said gas outlet and connected by a gas outlet tube to said barrel.

3. The improved heating torch as claimed in claim 1, wherein said flame device comprises a jacket, a refractory ring fitted at a front end of said jacket, a flame nozzle disposed in said refractory ring, a gas outlet tube shaft connected to said flame nozzle, a gas nozzle and a spring, said flame device being fitted and locked to said gas core seat with said spring forced thereagainst, and a recess formed in said jacket for accommodating a regulating ring having a notch in one side thereof, said notch corresponding to an air vent in said gas outlet tube shaft for regulating the ratio of air to fuel gas.

4. The improved heating torch as claimed in claim 2, wherein said casing unit comprises a left casing, a right casing and a securing lid for covering said gas release device, and wherein at positions corresponding to engagement of said casing unit with said tenons on said top mounting, holes are provided in said casing unit for engagement of said casing unit and said top mounting, said left casing and said right casing each having a lock hole, and after said securing lid is positioned on said gas release device, a screw passed through each lock hole in said left and right casings respectively and holes in said walls of said top mounting secures said casing unit to said top mounting.

5. The improved heating torch as claimed in claim 2, wherein a portion of said parallel walls of said top mounting is configured into an inclined wall for accommodating said gas core seat which is polygonal in shape.

6. The improved heating torch as claimed in claim 4, wherein ribs are provided at rear ends of said left and right casings respectively so as to engage the button rim of said switch button to thereby prevent said switch button from disengaging from said switch rotor.

* * * * *